United States Patent [19]

Ishige et al.

[11] 4,070,508

[45] Jan. 24, 1978

[54] RECORDING METHOD COMPRISING REACTING CELLULOSE FIBER WITH A BASIC COLOR FORMER

[75] Inventors: Sadao Ishige; Hideo Usui, both of Minami-ashigara; Hajime Kato, Fujimiya; Keiso Saeki, Fujimiya; Masataka Kiritani, Fujimiya, all of Japan

[73] Assignee: Fuji Photo Film Co., Ltd., Minami-ashigara, Japan

[21] Appl. No.: 570,976

[22] Filed: Apr. 23, 1975

[30] Foreign Application Priority Data

Apr. 23, 1974 Japan ..... 49-45090

[51] Int. Cl.[2] ..... B41M 5/12; B41M 5/14; B41M 5/16; B41M 5/18

[52] U.S. Cl. ..... 427/282; 8/54.2; 282/27.5; 427/150; 427/151; 427/256; 427/288; 428/323; 428/326; 428/537; 428/913; 428/914

[58] Field of Search ..... 427/150, 151, 288, 256, 427/282; 8/7, 54.2 R, 120; 282/27.5; 428/326, 535, 323, 537, 913, 914

[56] References Cited

U.S. PATENT DOCUMENTS

| | | | |
|---|---|---|---|
| 3,455,721 | 7/1969 | Phillips et al. | 282/27.7 |
| 3,672,935 | 6/1972 | Miller et al. | 282/27.7 |

*Primary Examiner*—Thomas J. Herbert, Jr.
*Assistant Examiner*—John D. Smith
*Attorney, Agent, or Firm*—Sughrue, Rothwell, Mion, Zinn and Macpeak

[57] ABSTRACT

A recording method and material employing a basic color former component which changes to a colored species by an interaction with a cellulose fiber and has a molecular extinction coefficient of not less than about 100 in an ethyl alcohol solution.

20 Claims, No Drawings

RECORDING METHOD COMPRISING REACTING CELLULOSE FIBER WITH A BASIC COLOR FORMER

BACKGROUND OF THE INVENTION

1. Field of the Invention

The present invention relates to a recording method and material. More particularly, it relates to a recording method and material employing a color former which forms a clear color image by adsorption on or reaction with a cellulose fiber.

2. Description of the Prior Art

Heretofore, recording materials which actually utilize a color former include a pressure-sensitive recording paper (e.g., as disclosed in U.S. Pat. Nos. 2,505,470, 2,505,489, 2,550,471, 2,548,366, 2,712,507, 2,730,456, 2,730,457, 3,418,250, etc.) and a heat-sensitive recording paper (e.g., as described in Japanese Patent Publication No. 4,160/68; U.S. Pat. No. 2,939,009, etc.). In these cases, to obtain a recording image, a colorless or a substantially colorless electron-donating organic compound (hereinafter designated "color former") is changed to a colored species by adsorption or reaction, and an acid reactive inorganic or organic acid electron-accepting material (hereinafter designated "developer") having capability to form a clear color image is required.

In addition, a recording or printing method which produces a color image by supplying an ink containing a color former onto a recording sheet coated with a developer thereon through a medium such as a felt pen or a stencil (e.g., as described in German Patent Application No. OLS 1,939,624 and Japanese Patent Publication No. 28,129/73), is known.

Further, a method for obtaining a color image by contacting a crayon-type color former onto a recording sheet coated with a developer is known.

In most cases, the color forming phenomenon of the color former as described above requires a physical stimulus such as the application of a pressure with a pen, typewriter, or the like, application of heat, etc.

Of these, a pressure-sensitive copying paper is the most representative form. A pressure-sensitive copying paper comprises a combination of a capsule-coated sheet which is a sheet on which is coated isolated liquid droplets contained in microcapsules containing a color former dissolved in a water-insoluble organic solvent, that is, a color former dissolving oil, and a developer sheet which is a sheet on which is coated an acid reactive material which forms a color image by reacting with the color former. To obtain a copied image, the capsule-coated paper is superposed on the developer sheet so that the capsule-coated surface can contact the developer coated surface, and then a localized pressure is applied using a pen, typewriter, etc. At this moment, the capsules are ruptured and the color former containing oil released from the capsules contacts the developer layer, and the color former and the developer react to form a densely colored copied image.

Further, according to another embodiment of a pressure-sensitive copying paper in practical use, the microcapsules encapsulating the color former containing oil and the developer are separately coated on opposite surface of the retaining sheet, or in one layer or two or more layers on the same surface of the sheet.

Heretofore, color formers used for the pressure-sensitive copying papers and other recording materials include Crystal Violet lactone, Benzoyl Leuco Methylene Blue, 3-diethylamino-7-dibenzylaminofluoran, 3-methyl-2,2-spirobi(benzo [f]-chromene), etc. When these color formers are used, acid reactive organic or inorganic acid materials, that is, developers are necessary, as has already been described, to obtain recorded images. Typical developers include clay minerals such as terra abla, activated clay, attapulgite, a condensate of phenol and formaldehyde, a phenol compound, aluminum salt, zinc salt, or magnesium salt of a salicylic acid derivative, a phenolate of aluminum, zinc, or magnesium, etc.

Since known recording materials require coating of color formers to obtain color images, the following disadvantages arise.

1. The paper coated with the color former differs from the uncoated paper, and printability is poor as compared with a high quality paper. That is, the clay mineral developer coated sheet, as compared with usual papers for printing, easily causes clogging of the printing plate in long-run printing. Also, a phenol-formaldehyde resin coated paper has a difficulty in that the drying speed of an ink after printing is somewhat slower.

2. Since the active surface of the developer sheet generally is stored uncovered and in contact with the air, a decrease of developing ability due to contamination by adsorption, etc., and yellowing of the developer sheet surface due to light are inevitable.

3. A coating procedure is necessary to coat the developer. In paper manufacturing, coating with a size press can be used, however, such a coating is not practical due to the poor color image density obtained when known color formers are used.

Considering the above descriptions, it can be understood that, if the use of special developers were to become unnecessary in recording materials utilizing the color forming reaction of color formers, the above-described disadvantages would all be removed.

SUMMARY OF THE INVENTION

After much research, it has now been found that some color formers do not require a reaction with a developer to form color images, and color images can be formed by ring cleavage of the color formers upon adsorption onto cellulose fibers such as paper. Thus, it has been found that a novel recording method and material having many advantages can be obtained utilizing this phenomenon.

Therefore, an object of the present invention is to provide a recording method and material which does not require the pressure of a color developer.

Another object of the present invention is to provide color formers which can be employed to form color without the necessity for a color developer.

A further object of the present invention is to provide a recording system utilizing a color former which does not require a color developer.

The above-described objects of the present invention are attained by using a basic color former component which changes to a colored species by an interaction with a cellulose fiber and has a molecular extinction coefficient of not less than about 100 in an ethyl alcohol solution.

DETAILED DESCRIPTION OF THE INVENTION

While the mechanism of the color forming reaction of the color former is not at present completely clear and while not desiring to be bound the above-described color forming phenomenon can be considered to occur as follows, that is, the color former adsorbed on a cellulose fiber undergoes a ring-opening due to the hydroxyl group of the cellulose fiber changing to a colored species and forming a color image. That is, it is believed that the colored dye becomes colorless due to ring closure to form the substantially colorless color former and when the color former is adsorbed on the cellulose fiber, the color former changes to the colored species again by ring cleavage due to a reaction with the hydroxyl group. Therefore, undoubtedly the hydroxyl group of the cellulose plays an important role in the present invention.

The basic color forming components, that is, the color formers, which exhibit such a phenomenon include both known and novel compounds. It has now been found that compounds which exhibit this phenomenon must have the property that, when they are dissolved in ethyl alcohol, the solution is densely colored. It has been further found that a good correlation exists in both the hue and the optical density between the coloring phenomenon on cellulose and in ethyl alcohol. Therefore, ability to use a color former in the present invention, i.e., whether the color former is suitable, can be determined by measuring the optical density in an ethyl alcohol solution. The optical density in an ethyl alcohol can easily be converted into a molecular extinction coefficient ($\epsilon$) at the wavelength of the absorption maximum in the ethyl alcohol solution by one skilled in the art.

Here, $\epsilon$ is defined by the following equation:

$$\epsilon = \frac{D}{dM}$$

where D is $-\log I/I_o$, $I/I_o$ is the transmittance, in which $I_o$ is that of ethyl alcohol and I is that of ethyl alcohol plus the color former, M is the molar concentration (in mole/$l$), and $d$ is the thickness of the solution to be measured (in cm).

The color former to be used for the present invention must have a molecular extinction coefficient of not less than about 100. That is, when a color former having an $\epsilon$ of less than 100 is used in the present invention, a color image is obtained, but the optical density of the color image is small and insufficient for practical use. Therefore, the color former for the present invention must have an $\epsilon \leqq 100$. The higher the value of $\epsilon$is, the larger is the optical density of the color image on the cellulose fiber, and especially a value of $\epsilon$ of not less than 1000 is more advantageous. That is, to obtain an even more useful color image density, an $\epsilon \leqq 1000$ is preferred. The larger the value of $\epsilon$ is, the smaller the concentration of the color former can be, therefore there is no upper limit for $\epsilon$ from the standpoint of the effects in the present invention.

It is known that Beer's law holds for light absorption in a solution where the solvent thereof is transparent like ethyl alcohol.

Beer's law provides that "the amount of light absorption in a medium is proportional to a number of molecules of the light absorbing substance in the light path". In other words, it can be said that "in a solution comprising a light absorbing substance dissolved in a transparent solvent, the amount of light absorption is proportional to the molar concentration of the light absorbing substance". This law can be equationally expressed as $$D = \log I_o/I = \epsilon Md.$$

When Beer's law applies, $\epsilon$ is a constant which is independent of the concentration. Also, this is the principle to obtain the $\epsilon$ which is a constant specific to a particular substance by measuring the transmittance $I/I_o$, and is fundamental in spectroscopy. In addition, the requirement of $\epsilon \geqq 100$ in an ethyl alcohol solution of the color former for the present invention can be replaced by $I/I_o \times 100 \leqq 89.0(\%)$, when the transmittance of the solution of the color former at a concentration of $5 \times 10^{-4}$ mole/$l$ in a cell having an inner thickness of 1 cm is measured at the absorption maximum wavelength. Further, an especially suitable range is $I/I_o \times 100 < 31.6$ (%) for a solution at a concentration of $5 \times 10^{-4}$ mole/$l$.

It is well known that a color former which is a basic leuco organic compound and is generally used for a recording material is a compound which exhibits a color forming reaction with a solid acid. The definition as described immediately above also applies to the color former to be used for the present invention except that the already-described requirement for $\epsilon \geqq 100$ must be satisfied. Examples of such color formers include fluoran type, fluoran analog type, diphenylphthalide analog type, diphenylphthalide modified type (i.e., the basic diphenylphthalide nucleus is modified as described hereinafter by the examples thereof), spiropyran type, etc., color formers. All these color formers change to a colored species by ring cleavage and form recording images.

Unlike the color former defined in the present invention, color formers which have heretofore been used for recording materials do not form a color with cellulose fibers and do not have any color forming ability in an ethyl alcohol solution. That is, these two properties are peculiar to the present invention.

The cellulose fiber on which the color former of the present invention is adsorbed and a color formed is, in general, used for paper manufacturing in the form of a pulp comprising a cellulose having a degree of polymerization of about 100 to 5000 and a hemicellulose having a degree of polymerization of not more than about 100, e.g., about 10 to about 100. Also, an esterified or etherified cellulose, in which the degrees of esterification and etherification can suitably range from about 0.1 to 2, preferably 0.4 to 1.5, such as acetylcellulose, nitrocellulose, methyl cellulose, ethyl cellulose, oxyethylcellulose, benzyl cellulose, butyl cellulose, cellulose p-toluenesulfonate, cellulose sulfate, cellulose phosphate, etc., and a product obtained by the graft-polymerization of styrene, methyl methacrylate, acrylonitrile, or the like to cellulose with a degree of graft polymerization ranging from about 0.1 to 2, preferably 0.5 to 1.5 and a molecular weight ranging from about 100 to 10,000, are suitable to provide the effects of the present invention. From the standpoint of color developing ability, the color former of the present invention forms a color with all substances made up of glucose nuclei, however, a substance which is particularly suitable is mainly pulp.

Examples of pulp which can be used for the present invention include beaten wood pulp, semi-chemical pulp, chemical beaten wood, sulfite pulp, kraft pulp, etc., and papers manufactured therefrom can be used as recording sheets for the present invention.

Examples of papers which can be used for the present invention include the generally used high quality paper, medium quality paper, rough paper, machine coated paper, art paper, cast coated paper, etc.

Further, another embodiment of the cellulose fiber for the present invention which can be used to cause the color former to form a color can be a flock of the cellulose fiber coated on a substrate using a binder. A suitable length of the cellulose fiber can range from about 1 μ to 1 cm.

Suitable substrates include a synthetic resin film, a resin coated paper, a synthetic paper, a paper, etc.

Typical binders which can be used include latexes such as a styrene-butadiene rubber latex, a styrene-butadiene latex, an acrylonitrile latex, a styrene-maleic anhydride copolymer latex, etc.; water-soluble natural polymer compounds such as a protein (e.g., gelatin, gum arabic, albumin, casein, etc.), a cellulose (e.g., carboxymethyl cellulose, hydroxyethyl cellulose, etc.), a saccharide (e.g., agar-agar, sodium alginate, starch, carboxymethyl starch, etc.); water-soluble synthetic polymer compounds such as polyvinyl alcohol, polyvinyl pyrrolidone, polyacrylic acid, polyacrylamide, etc.; organic solvent-soluble polymer compounds such as nitrocellulose, ethyl cellulose, a polyester, polyvinyl acetate, polyvinylidene chloride, a vinyl chloride-vinylidene chloride copolymer, etc. These binders can also be used as binders for the dispersion of the capsules. These polymer substances used for the binder usually have molecular weights of about 1,000 to 10,000,000, and advantageously 10,000 to 5,000,000.

From an economical standpoint the amount of the binder used preferably is as small as possible, since the object of the binder is to simply adhere the powder or flock of the cellulose fiber to the substrate. Suitably about 5 to 20 parts by weight of the binder per 100 parts by weight of solid components can be used, however, this range is merely exemplary and should not be considered as limiting the present invention.

The recording method of this invention comprises contacting the color former of this invention as described above with cellulose fiber as described above.

The recording material of the present invention can have the same form as known recording materials utilizing already-described known color formers and acid reactive materials, e.g., as described in U.S. Pat. Nos. 2,712,507, 2,730,456, 2,730,457, 3,666,525, etc. That is, a heat-sensitive paper can be obtained by coating the color former used in the present invention with a thermofusible material such as acetanilide on paper, and a pressure-sensitive recording paper can be obtained by coating microcapsules containing the color former therein on paper. Also, a color image can be obtained by applying an ink containing the color former onto paper through a medium such as a felt pen or a stencil. Further, a print can be obtained by applying the above-described ink onto cotton cloth. In addition, a copy of an original pattern and a rough sketch can be obtained by superposing a capsule sheet containing the color former for the present invention on an engraved printing plate made of wood and by writing with pressure. That is, wood can also be used as a recording material.

As an example of the present invention, the present invention is applicable to a pressure-sensitive copying paper as already described. In a pressure-sensitive copying paper, a most preferred method comprises dissolving a single color former or a mixture of two or more color formers in a water-insoluble organic solvent and then encapsulating the solution into microcapsules.

The solvents for the color former which can be used in the present invention are not limited, and all known solvents can be used. Examples of suitable are aromatic synthetical oils such as triaryldimethanes, diethyl phthalate, dibutyl phthalate, dioctyl phthalate, alkylated naphthalene, alkylated biphenyl, hydrogenated terphenyl, alkylated diphenylmethane (where each alkyl group has about 1 to 5 carbon atoms and the number of alkyl groups is 1 to 4), petroleum fractions, such as kerosene, naphtha, paraffin, aliphatic synthetic oils such as chlorinated paraffin, etc., vegetable oils such as cotton seed oil, soy bean oil, linseed oil, etc., and mixtures thereof. The concentration of the solution of the color former is not particularly limited, and by referring to the concentration (not less than about 0.1% by weight, preferably 1 to 10% by weight) of the solution of a color former used for a known pressure-sensitive copying paper, microcapsules can easily be produced by one skilled in the art.

Also, suitable methods for producing microcapsules are those methods well known in the art. That is, since the color forming phenomenon in the present invention depends on the reaction of the color former and the cellulose fiber, the method for producing microcapsules is not limited in the present invention.

The microcapsules can be produced using, for instance, a coacervation method as described in U.S. Pat. Nos. 2,800,457, 2,800,458, 3,041,289, 3,687,865, etc., an interfacial polymerization method as described in U.S. Pat. Nos. 3,492,380 and 3,577,515; British Pat. Nos. 950,443, 1,046,409 and 1,091,141, etc., an internal in situ polymerization method as described in British Patent 1,237,498; French Pat. Nos. 2,060,818 and 2,090,862, etc., an external in situ polymerization method as described in British Pat. No. 989,264; Japanese Patent Publication Nos. 12,380/62, 14,327/62, 29,483/70, 7,313/71 and 30,282/71, etc.

Mononuclear microcapsules are preferred, but the objects of the present invention can be achieved with multinuclear microcapsules. Also, the size of microcapsules usually ranges from about 1 to about 500 μ, preferably about 2 to about 50 μ. Microcapsules of about the same size can be advantageously used in the present invention.

A coating solution containing microcapsules is usually a dispersion of microcapsules and can simply be coated on a substrate. Further, to the dispersion of the microcapsules or to the microcapsules separated from the dispersion can be added a binder such as a latex (e.g., a styrene-butadiene rubber latex, etc.), a water-soluble polymer material (e.g., starch, carboxymethyl cellulose, polyvinyl alcohol, gum arabic, casein, gelatin, etc.), etc. In addition, in the microcapsule coating solution or the microcapsule wall a capsule reinforcing agent such as a cellulose fine powder as described in U.S. Pat. No. 2,711,375, a polymer fine powder as described in U.S. Pat. No. 3,625,736, a starch fine powder as described in British Pat. No. 1,232,347, and microcapsules not containing a color former therein as described in British Pat. No. 1,235,991 can be added. The capsule reinforcing agent preferably is not present in the form of a layer but is distributed throughout the capsule coated layer or on the surface of the capsule layer.

Suitable methods for coating the capsule coating solution on a substrate include an air knife coating method, a roll coating method, a blade coating method, a brush coating method, etc. These methods can easily be selected by one skilled in the art.

The following Measuring Method for the $\epsilon$ of the color former and Examples illustrate the present invention in greater detail.

All parts, percents, ratios and the like herein are by weight unless otherwise indicated.

MEASURING METHOD 1

$5 \times 10^{-4}$ mole of the following color former was put into a 100 m*l* flask and then ethyl alcohol was added to make the volume 100 m*l*. After the color former crystals were completely dissolved, 1 m*l* of the color former solution was removed using a 1 m*l* pipette and put into a 10 m*l* flask. The solution was diluted to 10 m*l* with ethyl alcohol to obtain an ethyl alcohol solution of the color former at a concentration of $5 \times 10^{-4}$ mole/*l*. The thus-obtained ethyl alcohol solution was put into a quartz cell having a solution thickness of 1 cm, and then an absorption spectrum was measured over the wavelength region from 400 mμ to 700 mμ. The measurement was conducted using a spectrophotometer Model UV-200 manufactured by Shimazu Seisakusho Co., Ltd. The results of the measurement for transmittance $I/I_o \times 100(\%)$ and $\epsilon$ are shown in Table 1.

TABLE 1

| No. | Compound | Structural Classification | Absorption Maximum Wavelength | Transmittance of $5 \times 10^{-4}$ mol/l | $\epsilon$ |
|---|---|---|---|---|---|
| | | | (mμ) | (%) | |
| 1 | Spiro[xanthene-9,1'-phthalan]-3,6-bis(N-methyl-anilino)-3'-one | Fluoran type | 535 | 0.3 | 5100 |
| 2 | Spiro[xanthene-9,1'-phthalan]-3,6-bis(N-methyl-anilino)-4',5',6',7'-tetrachloro-3'-one | " | 568 | Not more than 0.1 | Not less than 6000 |
| 3 | Spiro[xanthene-9,1'-phthalan]-3,6-bis(N-ethyl-anilino)-4',5',6',7'-tetrachloro-3'-one | " | 568 | Not more than 0.1 | Not less than 6000 |
| 4 | Spiro[xanthene-9,1'-phthalan]-3,6-bis[N-methyl-(o-anisidino)]-4',5',6',7'-tetrachloro-3'-one | " | 564 | Not more than 0.1 | Not less than 6000 |
| 5 | Spiro[xanthene-9,1'-phthalan]-3,6-bis[N-methyl-(p-chloroanilino)]-4',5',6',7'-tetrachloro-3'-one | " | 568 | 7.9 | 2200 |
| 6 | Spiro[11H-benzo[b]thieno[3,2-b]chromene-11,1'-phthalan]-3-diethylamino-7-methyl-3'-one | Fluoran analog type | 540 | 35.8 | 890 |
| 7 | Spiro[8H-naphtho[2,1-b]thieno-[3,2-b]chromene-8,1'-phthalan]-11-diethylamino-3'-one | " | 552 | 7.9 | 2200 |
| 8 | Spiro[11H-benzo[b]thieno[3,2-b]chromene-11,1'-phthalan]-8-chloro-3-diethylamino-6-methyl-3'-one | Fluoran analog type | 544 | 35.4 | 900 |
| 9 | 7-Chloro-1,3-dihydro-1,1-bis(p-dimethyl aminophenyl)-3-oxo-benzo[b]thieno[2,3-C]furan | Diphenyl phthalide analog type | 627 | Not more than 0.1 | Not less than 6000 |
| 10 | 1,3-Dihydro-1,1-bis(p-dimethylaminophenyl)-3-one-benzo[b]thieno[2,3-C]furan | " | 622 | 0.25 | 5200 |
| 11 | 1,3-Dihydro-1,1-bis(p-diethylaminophenyl)-3-oxo-benzo[b]thieno[2,3-C]furan | Diphenyl-phthalide analog type | 628 | Not more than 0.1 | Not less than 6000 |
| 12 | 1,3-Dihydro-1,1-bis(p-dimethylaminophenyl)-7-methyl-3-oxo-benzo[b]thieno[2,3-C]furan | " | 620 | 2.0 | 3400 |
| 13 | 1,3-Dihydro-1-[p-(N-benzyl-N-methylamino)-phenyl]-1-(p-dimethylaminophenyl)-3-oxo-benzo[b]thieno[2,3-C]furan | " | 623 | 2.0 | 3400 |
| 14 | 1,3-Dihydro-1-(p-dibenzylaminophenyl)-1-(p-dimethylaminophenyl)-3-oxo-benzo[b]-thieno[2,3-C]furan | " | 622 | 20.0 | 1400 |
| 15 | 1,3-Dihydro-1-(p-dimethylaminophenyl)-1-[p-(N-methylanilino)phenyl]-3-oxo-benzo[b]thieno[2,3-C]furan | " | 624 | 35.4 | 890 |
| 16 | 1,3-Dihydro-1,1-bis[p-(N-benzyl-N-methylamino)-phenyl]-3-oxo-benzo[b]thieno[2,3-C]furan | Diphenyl-phthalide analog type | 626 | 4.0 | 2800 |
| 17 | 1,3-Dihydro-1,1-bis[p-(N-benzyl-N-ethylamino)-phenyl]-3-oxo-benzo[b]thieno[2,3-C]furan | " | 628 | 4.0 | 2800 |
| 18 | 4H-7-Dimethylamino-4,4-bis(p-dimethylamino-phenyl)-2-phenyl-3,1-benzoxazine | Diphenyl-phthalide modified type | 604 | Not more than 0.1 | Not less than 6000 |
| 19 | 4H-7-Diethylamino-2-methyl-4,4-bis(p-dimethyl-aminophenyl)-3,1-benzoxazine | diphenyl-phthalide modified type | 610 | Not more than 0.1 | Not less than 6000 |
| 20 | 4H-6-Methyl-4,4-bis(p-dimethylaminophenyl)-2-phenyl-3,1-benzoxazine | " | 630 | 64.0 | 390 |
| 21 | 4H-2-Ethoxy-6-methyl-4,4-bis(p-dimethylamino-phenyl)3,1-benzoxazine | " | 625 | 65.3 | 370 |
| 22 | 4H-7-Dibenzylamino-4,4-bis(p-dimethylamino-phenyl)-2-phenyl-benzoxazine | " | 660 | Not more than 0.1 | Not less than 6000 |
| 23 | 7-Diethylamino-2,2'-spiro-bi(2H-chromene) | Spiropyran type | 585 | Not more than 0.1 | Not less than 6000 |
| 24 | 7-Diethylamino-spiro-[chromene-2,2'-benzo[f]chromene] | Spiropyran type | 660 | Not more than 0.1 | Not less than 6000 |
| 25 | 7'-Diethylamino-3,3-dimethyl-1-phenyl-spiro[indoline-2,2'-chromene] | " | 567 | Not more than 0.1 | Not less than 6000 |
| 26 | 7-Diethylamino-3'-methyl-2,2'-spiro-bi(2H-chromene) | " | 615 | Not more than 0.1 | Not less than 6000 |
| 27 | 7-Diethylamino-3'-methyl-spiro[chromene-2,2'-benzo[f]chromene] | " | 690 | Not more than 0.1 | Not less than 6000 |

EXAMPLE 1

6 parts of acid treated pig skin gelatin having an isoelectric point of 8.2 and 6 parts of gum arabic were dissolved in 30 parts of water at 40° C. To this solution was added 0.2 part of sodium nonylbenzenesulfonate as an emulsifying agent.

To the colloid solution 30 parts of a diisopropylnaphthalene oil solution of the color formers shown in Table 2 at a concentration of 2.5% was added with vigorous stirring to emulsify and form an o/w emulsion. The stirring was stopped when the size of the oil droplets became 6 ~ 10 μ. 200 parts of warm water at 40° C was added to this emulsion, then an aqueous solution of hydrochloric acid of a concentration of 20% was added dropwise with stirring to adjust the pH of the emulsion to 4.4. The emulsion was then cooled from outside of the vessel with stirring to gel the colloid walls deposited around the oil droplets. On continuing the stirring, 2.0 parts of an aqueous solution of formaldehyde of a concentration of 37% was added to the emulsion, when the temperature of the emulsion became 10° C. Further, 20 parts of an aqueous solution of the sodium salt of carboxymethyl cellulose (having a degree of etherification of 7.5) at a concentration of 7% was added. Then, an aqueous solution of sodium hydroxide at a concentration of 10% was added until the pH of the system became 10, and then the emulsion was heated from outside of the vessel to 40° C and held at this temperature for 1 hour to obtain microcapsules containing the color former.

The thus-obtained capsules were useful for a pressure-sensitive copying paper. For instance, to 100 parts of the capsule slurry 10 parts of an aqueous solution of PVA-210 (a trade name, made by Kuraray Co., Ltd.) at a concentration of 10% and 3 parts of corn starch were added, and then the mixture was coated on a 50 g/m² paper at a coating rate of 5.5 g/m² and dried.

TESTING METHOD AND RESULTS

The capsule sheets obtained by Example 1 were superposed on a 50 g/m² high quality paper and pressed with a pressure of 600 kg/cm² to form color.

After storage in a dark place for one day, the reflection spectra of the color images were measured at a wavelength ranging from 380 to 700 mμ using a Beckman spectrophotometer Model DB, and color image densities are shown in Table 2 using the absorbances at the absorption maxima.

TABLE 2

| No. | Compound | Structural Classification | Color Image Density |
|---|---|---|---|
| 1 | Spiro[xanthene-9,1'-phthalan]-3,6-bis(N-methylanilino)-3'-one | Fluoran type | 0.45 |
| 2 | Spiro[xanthene-9,1'-phthalan]-3,6-bis(N-methylanilino)-4',5',6',7'-tetrachloro-3'-one | " | 0.46 |
| 3 | Spiro[xanthene-9,1'-phthalan]-3,6-bis(N-ethylanilino)-4',5',6',7'-tetrachloro-3'-one | " | 0.46 |
| 4 | Spiro[xanthene-9,1'-phthalan]-3,6-bis(N-methyl(o-anisidino)]-4',5',6',7'-tetrachloro-3'-one | " | 0.59 |
| 5 | Spiro[xanthene-9,1'-phthalan]-3,6-bis(N-methyl(p-chloroanilino)]-4',5',6',7'-tetrachloro-3'-one | " | 0.30 |
| 6 | Spiro[11H-benzo[b]thieno[3,2-b]chromene-11,1'-phthalan]-3-diethylamino-7-methyl-3'-one | Fluoran analog type | 0.29 |
| 7 | Spiro[8H-naphtho[2,1-b]thieno[3,2-b]chromene-8,1'-phthalan]-11-diethylamino-3'-one | " | 0.30 |
| 8 | Spiro[11H-benzo[b]thieno[3,2-b]chromene-11,1'-phthalan]-8-chloro-3-diethylamino-6-methyl-3'-one | " | 0.24 |
| 9 | 7-Chloro-1,3-dihydro-1,1-bis(p-dimethylaminophenyl)-3-oxo-benzo[b]thieno[2,3-C]furan | Diphenylphthalide analog type | 0.57 |
| 10 | 1,3-Dihydro-1,1-bis(p-dimethylaminophenyl)-3-oxo-benzo[b]thieno[2,3-C]furan | " | 0.60 |
| 11 | 1,3-Dihydro-1,1-bis(p-diethylaminophenyl)-3-oxo-benzo[b]thieno[2,3-C]furan | " | 0.67 |
| 12 | 1,3-Dihydro-1,1-bis(p-dimethylaminophenyl)-7-methyl-3-oxo-benzo[b]thieno[2,3-C]furan | Diphenylpthalide analog type | 0.63 |
| 13 | 1,3-Dihydro-1-[p-(N-benzyl-N-methylamino)phenyl]-1-(p-dimethylaminophenyl)-3-oxo-benzo[b]thieno-[2,3-C]furan | " | 0.53 |
| 14 | 1,3-Dihydro-1-(p-dibenzylaminophenyl)-1-(p-dimethylaminophenyl)-3-oxo-benzo[b]thieno-[2,3-C]furan | " | 0.38 |
| 15 | 1,3-Dihydro-1-(p-dimethylaminophenyl)-1-[p-(N-methylanilino)phenyl]-3-oxo-benzo[b]thieno-[2,3-C]furan | " | 0.30 |
| 16 | 1,3-Dihydro-1,1-bis[p-(N-benzyl-N-benzyl-N methylamino)phenyl]-3-oxo-benzo[b]thieno-[2,3-C]furan | " | 0.42 |
| 17 | 1,3-Dihydro-1,1-bis[p-(N-benzyl-N-ethylamino)-phenyl]-3-oxo-benzo[b]thieno[2,3-C]furan | " | 0.47 |
| 18 | 4H-7-Dimethylamino-4,4-bis(p-dimethylaminophenyl)-2-phenyl-3,1-benzoxazine | Diphenylphthalide modified type | 0.53 |
| 19 | 4H-7-Diethylamino-2-methyl-4,4-bis(p-dimethylaminophenyl)-3,1-benzoxazine | " | 0.60 |
| 20 | 4H-6-Methyl-4,4-bis(p-dimethylaminophenyl)-2-phenyl-3,1-benzoxazine | " | 0.31 |
| 21 | 4H-2-Ethoxy-6-methyl-4,4-bis(p-dimethylaminophenyl)-3,1-benzoxazine | " | 0.49 |
| 22 | 4H-7-Dibenzylamino-4,4-bis(p-dimethylaminophenyl)-2-phenyl-benzoxazine | Diphenylphthalide modified type | 0.49 |
| 23 | 7-Diethylamino-2,2'-spiro-bi(2H-chromene) | Spiropyran type | 0.54 |
| 24 | 7-Diethylamino-spiro[chromene-2,2'-benzo[f]-chromene] | " | 0.60 |
| 25 | 7'-Diethylamino-3,3-dimethyl-1-phenyl-spiro-[indoline-2,2'-chromene] | " | 0.50 |
| 26 | 7-Diethylamino-3'-methyl-2,2'-spiro-bi(2H-chromene) | " | 0.48 |
| 27 | 7-Diethylamino-3'-methyl-spiro[chromene-2,2'-benzo[f]chromene | " | 0.55 |

EXAMPLE 2

9 g of the following finely divided color formers and 100 g of acetanilide were added to an aqueous solution comprising of 30 g of polyvinyl alcohol and 500 g of water and then dispersed therein. This dispersion was blended in a ball mill for 5 hours. The dispersion was then coated on a paper and dried to obtain a heat-sensitive copying sheet. The sheet was superposed on an original and was heated using a thermographic printer (Thermofax Secretary, manufactured by 3M Co.), and brilliant color images having the following hues were obtained.

| | |
|---|---|
| Spiro[xanthene-9,1'-phthalan]-3,6-bis(N-methylaniline)-3-one | Red |
| Spiro[8H-naphtho[2,1-b]thieno-[3,2-b]chromene-8,1'-phthalan]-11-diethylamino-3'-one | Reddish purple |
| 1,3-Dihydro-1-(p-dimethylaminophenyl)-1-[p-(N-methylanilino)phenyl]-3-oxo-benzo[b]thieno[7,3-C]furan | Blue |
| 4H-7-Dibenzylamino-4,4-bis(p-dimethylaminophenyl)-2-phenyl-benzoxazine | Blue |
| 7-Diethylamino-3'-methyl-spiro-[chromene-2,2'-benzo[f]chromene | Bluish green |

EXAMPLE 3

5 g of the following color formers was dissolved in 100 ml of toluene to obtain colorless inks. Brilliant recorded images having the following hues were obtained by writing with a felt pen containing the colorless ink on a paper.

| | |
|---|---|
| 7'-Diethylamino-3,3-dimethyl-1-phenyl-spiro[indoline-2,2'-chromene] | Bluish green |
| Spiro[xanthene-9,1'-phthalan]-3,6-bis(N-methylanilino)-4',5',6',7'-tetrachloro-3'-one | Reddish purple |
| Spiro[8H-naphtho[2,1-b]thieno-[3,2-b]chromene-8,1'-phthalan]-11-diethylamino-3'-one | Reddish purple |
| 1,3-Dihydro-1,1-bis(p-diethylamino-phenyl)-3-oxo-benzo[b]thieno[2,3-C]-furan | Blue |

EXAMPLE 4

Microcapsules as prepared in Example 1 were coated on a high quality paper and dried to obtain a recording material. A pressure of 600 kg/cm$^2$ was applied to this recording material to form color, and substantially the same results as described in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A recording method comprising forming a colored image by contacting with a cellulose fiber a basic color former component which changes to a colored species by an interaction with the cellulose fiber and has a molecular extinction coefficient of not less than about 100 in an ethyl alcohol solution, said color image being formed principally by the interaction of the color former and the cellulose fiber.

2. The recording method as described in Claim 1, wherein said color former is dispersed in a binder.

3. The recording method of Claim 1, wherein said color image is formed solely by the interaction of the color former and the cellulose fiber.

4. The recording method as described in claim 1, wherein said cellulose fiber is fiber produced from a graft-polymer of styrene, methyl methacrylate, methyl, or acrylonitrile and cellulose.

5. The recording method as described in claim 1, wherein said color former is mixed with a thermofusible material and said contacting includes heating.

6. The recording method as described in claim 1, wherein said color former is mixed with an inert solvent and contained in a writing instrument.

7. The recording method as described in claim 1, wherein said color former is mixed with an inert solvent and said contacting is by passing the solution through a stencil.

8. The recording method as described in claim 1, wherein said cellulose fiber is wood or cotton.

9. The recording method as described in claim 1, wherein said color former is contained in pressure-rupturable microcapsules.

10. The recording method as described in claim 9, wherein said contacting includes rupturing said capsules.

11. The recording method as described in claim 1, wherein said color former is a fluoran type, a fluoran analog type, a diphenylphthalide analog type, a diphenylphthalide modified type, or a spiropyran type color former.

12. The recording method as described in claim 11, wherein said fluoran type color former is spiro[xanthene-9,1'-phthalan[-3,6-bis(N-Methylanilino)-3'-one, spiro[xanthene-9,1'-phthalan]-3,6-bis(N-methylanilino)-4',5',6',7'-tetrachloro-3'-one, spiro[xanthene-9,1'-phthalan]-3,6-bis(N-ethylanilino)-4',5',6',7'-tetrachloro-3'-one, spiro[xanthene-9,1'-phthalan]3,6-bis[N-methyl-(o-anisidino)]-4',5',6',7'-tetrachloro-3'-one, or spiro[xanthene-9,1'-phthalan]-3,6-bis[N-methyl(p-chloroanilino)]-4',5',6',7'-tetrachloro-3'-one.

13. The recording method as described in Claim 11, wherein said fluoran analog type color former is spiro[11H-benzo[b]thieno[3,2-b]chromene-11,1'-phthalan]-3-diethylamino-7-methyl-3'-one, spiro[8H-naphtho[2,1-b]thieno[3,2-b]chromene-8,1'-phthalan]-11-diethylamino-3'-one, or spiro[11H-benzo[b]-thieno[3,2-b]chromene-11,1'-phthalan]-8-chloro-3-diethylamino-6-methyl-3'-one.

14. The recording method as described in claim 11, wherein said diphenylphthalide analog type color former is 7-chloro-1,3-dihydro-1,1-bis(p-dimethylamino-phenyl)-3-oxobenzo[b]thieno[2,3-C]furan, 1,3-dihydro-1,1-bis(p-dimethylaminophenyl)-3-oxo-benzo[b]-thieno[2,3-C]furan, 1,3-dihydro-1,1-bis(p-diethylamino-phenyl)-3-oxo-benzo[b]thieno[2,3-C]furan, 1,3-dihydro-1,1-bis(p-dimethylaminophenyl)-7-methyl-3-oxo-benzo[b]-thieno[2,3-C]furan, 1,3-dihydro-1-[p-(N-benzyl-N-methylamino)-phenyl]-1-(p-dimethylaminophenyl)-3-oxo-benzo[b]thieno[2,3-C]-furan, 1,3-dihydro-1-(p-dibenzylaminophenyl)-1-(p-dimethylaminophenyl)-3-oxo-benzo[b]thieno[2,3-C]furan, 1,3-dihydro-1-(p-dimethylaminophenyl)-1-[p-(N-methylanilino)phenyl]-3-oxo-benzo[b]thieno[2,3-C]furan, 1,3-dihydro-1,1-bis[p-(N-benzyl-N-methylanilino)phenyl]-3-oxo-benzo[b]-thieno[2,3-C]furan, or 1,3-dihydro-1,1-bis[p-(N-benzyl-N-ethylanilino)phenyl]-3-oxo-benzo[b]thieno[2,3-C]furan.

15. The recording method as described in claim 11, wherein said diphenylphthalide modified type color former is 4H-7-dimethylamino-4,4-bis(p-dimethylaminophenyl)-2-phenyl-3,1-benzoxazine, 4H-7-diethylamino-2-methyl-4,4-bis(p-dimethylaminophenyl)-3,1-benzoxazine, 4H-6-methyl-4,4-bis(p-dimethylamino-phenyl)-2-phenyl-3,1-benzoxazine, 4H-2-ethoxy-6-methyl-4,4-bis(p-dimethylaminophenyl)-3,1-benzoxazine, or 4H-7-dibenzylamino-4,4-bis(p-dimethylamino-phenyl)-2-benzoxazine.

16. The recording method as described in claim 11, wherein said spiropyran type color former is 7-dimethylamino-2,2'-spiro-bi(2H-chromene), 7-diethylamino-spiro[chromene-2,2'-benzo[f]chromene], 7'-diethylamino-3,3-dimethyl-1-phenylspiro[indoline-2,2'-chromene], 7-diethylamino-3'-methyl-2,2'-spiro-bi(2H-chromene), or 7-diethylamino-3'-methyl-spiro[chromene-2,2'-benzo[f]chromene].

17. The recording method as described in claim 1, wherein said cellulose fiber is a fiber produced from a cellulose pulp.

18. The recording method as described in claim 17, wherein said cellulose pulp is a beaten wood pulp, a semi-chemical pulp, a chemical beaten wood, a sulfite pulp, or a kraft pulp.

19. The recording method as described in claim 1, wherein said cellulose fiber is a fiber of an esterified cellulose or an etherified cellulose.

20. The recording method as described in claim 19, wherein said esterified or etherified cellulose is acetyl-cellulose, nitrocellulose, methyl cellulose, carboxy-methyl cellulose, ethyl cellulose, oxyethyl cellulose, benzyl cellulose, butyl cellulose, cellulose p-toluenesulfonate, cellulose sulfate, or cellulose phosphate.

* * * * *